US010750604B2

(12) United States Patent
Dijksman et al.

(10) Patent No.: US 10,750,604 B2
(45) Date of Patent: Aug. 18, 2020

(54) DROPLET GENERATOR FOR LITHOGRAPHIC APPARATUS, EUV SOURCE AND LITHOGRAPHIC APPARATUS

(71) Applicant: ASML NETHERLANDS B.V., Veldhoven (NL)

(72) Inventors: Johan Frederik Dijksman, Weert (NL); Wilhelmus Henricus Theodorus Maria Aangenent, Eindhoven (NL); Ronald Johannes Hultermans, Waalre (NL); Bastiaan Lambertus Wilhelmus Marinus Van De Ven, Rosmalen (NL); Peter Wilhelm Hendrik Van Putten, Eindhoven (NL)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 15/781,885

(22) PCT Filed: Nov. 22, 2016

(86) PCT No.: PCT/EP2016/078427
§ 371 (c)(1),
(2) Date: Jun. 6, 2018

(87) PCT Pub. No.: WO2017/102261
PCT Pub. Date: Jun. 22, 2017

(65) Prior Publication Data

US 2018/0368241 A1 Dec. 20, 2018

(30) Foreign Application Priority Data

Dec. 17, 2015 (EP) ..... 15200721

(51) Int. Cl.
*H05G 2/00* (2006.01)

(52) U.S. Cl.
CPC ..... *H05G 2/006* (2013.01); *H05G 2/005* (2013.01)

(58) Field of Classification Search
USPC ..... 250/504 R
See application file for complete search history.

(56) References Cited

U.S. PATENT DOCUMENTS 9,029,813 B2 * 5/2015 Fomenkov ..... B22F 3/105 250/504 R
9,544,982 B2 * 1/2017 Zhao ..... B05B 1/00
(Continued)

FOREIGN PATENT DOCUMENTS

CN 2744123 Y 11/2005
DE 102008037299 A1 2/2010
(Continued)

OTHER PUBLICATIONS

PCT/EP2016/078427 International Search Report dated May 7, 2017.

*Primary Examiner* — Phillip A Johnston
(74) *Attorney, Agent, or Firm* — DiBerardino McGovern IP Group LLC

(57) ABSTRACT

An EUV source for generating a beam of EUV radiation, has a droplet generator with a nozzle assembly to emit droplets of fuel from a nozzle towards a plasma formation location. The nozzle assembly receives the fuel from a reservoir. The nozzle assembly has a pump chamber receiving the fuel from the reservoir and an actuator to vibrate a membrane that forms a wall of the pump chamber. The wall is oriented perpendicularly to a direction wherein the nozzle emits the fuel. The nozzle assembly has first and second nozzle filters non-adjacently arranged in series in a path of the fuel from the pump chamber to the nozzle.

17 Claims, 3 Drawing Sheets

(56) References Cited

U.S. PATENT DOCUMENTS

| | | | |
|---|---|---|---|
| 2006/0017026 | A1 | 1/2006 | Hergenhan et al. |
| 2009/0232681 | A1 | 9/2009 | Ham et al. |
| 2011/0284774 | A1 | 11/2011 | Ishihara et al. |
| 2012/0292527 | A1 | 11/2012 | Fomenkov et al. |
| 2013/0153603 | A1 | 6/2013 | De Dea et al. |
| 2014/0070021 | A1 | 3/2014 | Yabu et al. |
| 2014/0217310 | A1 | 8/2014 | Hirashita et al. |
| 2014/0239203 | A1 | 8/2014 | Umeda et al. |

FOREIGN PATENT DOCUMENTS

| | | | |
|---|---|---|---|
| WO | 2012136343 | A1 | 10/2012 |
| WO | 2014024865 | A1 | 2/2014 |

* cited by examiner

DROPLET GENERATOR FOR LITHOGRAPHIC APPARATUS, EUV SOURCE AND LITHOGRAPHIC APPARATUS

CROSS-REFERENCE TO RELATED APPLICATIONS

This application is the U.S. National Stage Application of International Patent Application No. PCT/EP2016/078427, filed on Nov. 22, 2016 which claims priority of EP application 15200721.7 which was filed on Dec. 17, 2015 both of which are incorporated herein in their entirety by reference.

FIELD

The present invention relates to a lithographic apparatus and a specifically for a droplet generator for an EUV source within a lithographic apparatus.

BACKGROUND

A lithographic apparatus is a machine that applies a desired pattern onto a substrate, usually onto a target portion of the substrate. A lithographic apparatus can be used, for example, in the manufacture of integrated circuits (ICs). In that instance, a patterning device, which is alternatively referred to as a mask or a reticle, may be used to generate a circuit pattern to be formed on an individual layer of the IC. This pattern can be transferred onto a target portion (e.g. comprising part of, one, or several dies) on a substrate (e.g. a silicon wafer). Transfer of the pattern is typically via imaging onto a layer of radiation-sensitive material (resist) provided on the substrate. In general, a single substrate will contain a network of adjacent target portions that are successively patterned.

Lithography is widely recognized as one of the key steps in the manufacture of ICs and other devices and/or structures. However, as the dimensions of features made using lithography become smaller, lithography is becoming a more critical factor for enabling miniature IC or other devices and/or structures to be manufactured.

A theoretical estimate of the limits of pattern printing can be given by the Rayleigh criterion for resolution as shown in equation (1):

$$CD = k_1 * \frac{\lambda}{NA} \tag{1}$$

where λ is the wavelength of the radiation used. NA is the numerical aperture of the projection system used to print the pattern, k1 is a process dependent adjustment factor, also called the Rayleigh constant, and CD is the feature size (or critical dimension) of the printed feature. It follows from equation (1) that reduction of the minimum printable size of features can be obtained in three ways: by shortening the exposure wavelength λ, by increasing the numerical aperture NA or by decreasing the value of k1.

In order to shorten the exposure wavelength and, thus, reduce the minimum printable size, it has been proposed to use an extreme ultraviolet (EUV) radiation source. EUV radiation is electromagnetic radiation having a wavelength within the range of 5-20 nm, for example within the range of 13-14 nm. It has further been proposed that EUV radiation with a wavelength of less than 10 nm could be used, for example within the range of 5-10 nm such as 6.7 nm or 6.8 nm. Such radiation is termed extreme ultraviolet radiation or soft x-ray radiation. Possible sources include, for example, laser-produced plasma sources, discharge plasma sources, or sources based on synchrotron radiation provided by an electron storage ring.

EUV radiation may be produced using a plasma. A radiation system for producing EUV radiation may include a laser for exciting a fuel to provide the plasma, and a source collector apparatus for containing the plasma. The plasma may be created, for example, by directing a laser beam at a fuel, such as particles of a suitable material (e.g. tin), or a stream of a suitable gas or vapor, such as Xe gas or Li vapor. The resulting plasma emits output radiation, e.g., EUV radiation, which is collected using a radiation collector. The radiation collector may be a mirrored normal incidence radiation collector, which receives the radiation and focuses the radiation into a beam. The source collector apparatus may include an enclosing structure or chamber arranged to provide a vacuum environment to support the plasma. Such a radiation system is typically termed a laser produced plasma (LPP) source.

A proposed LPP radiation source generates a continuous stream of fuel droplets. The radiation source comprises a droplet generator for directing fuel droplets toward a plasma formation location. The droplet generator comprises a very small diameter nozzle which can become clogged, and therefore require periodic replacement. Additionally, it may be desirable to use driving gas pressures, for driving the fuel from a reservoir through the nozzle, greater than that possible with existing nozzle designs.

SUMMARY

The invention in a first aspect provides a droplet generator for a lithographic system being operable to receive fuel from a fuel reservoir via a main filter for filtering said fuel, said droplet generator comprising a nozzle assembly operable to emit said fuel in the form of droplets, wherein said nozzle assembly comprises a nozzle and one or more nozzle filters for further filtering of said fuel before emission through said nozzle.

The invention in a second aspect provides a droplet generator for a lithographic system being operable to receive fuel from a fuel reservoir, said droplet generator comprising in series: an actuator, a pump chamber, and a nozzle assembly comprising a nozzle; wherein said actuator is operable to act on said fuel in said pump chamber, so as to cause the break up of said fuel into droplets, and said nozzle assembly is operable to emit said droplet.

The invention in a third aspect provides an integrated nozzle filter and nozzle for emitting a fuel in the form of droplets, comprising: a nozzle filter for filtering the fuel; and a nozzle; wherein the nozzle filter and nozzle are integrated within a single nozzle substrate.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention. Embodiments of the invention are described, by way of example only, with reference to the accompanying drawings, in which.

Figure 3:
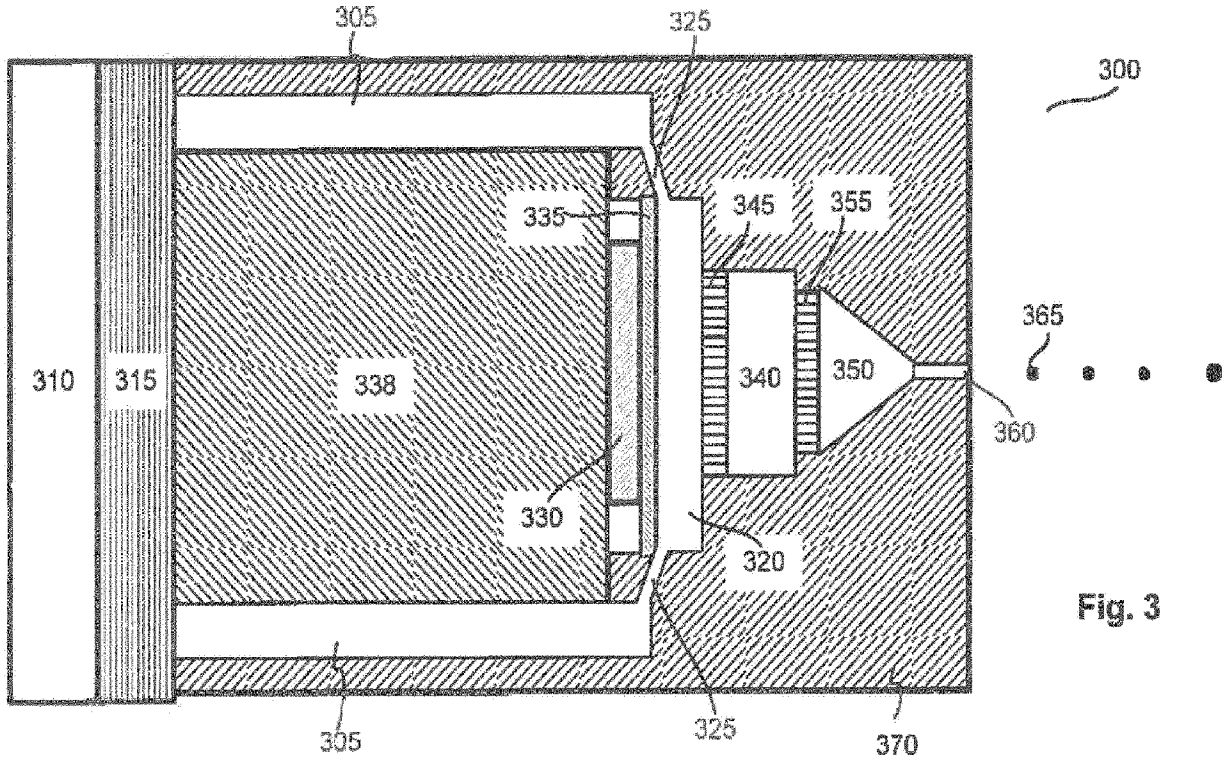
Figure 4:
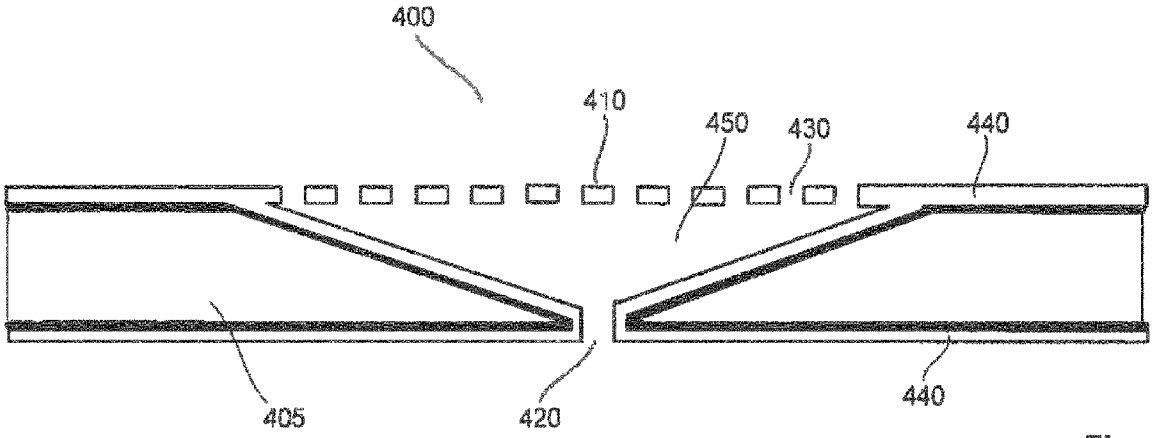

FIG. 3 schematically depicts a droplet generator of a radiation source configured to direct a stream of fuel droplets along a trajectory towards a plasma formation location, according to an embodiment of the invention; and FIG. 4 schematically depicts an integrated nozzle and filter arrangement usable in the the droplet generator of FIG. 3.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION OF EXEMPLARY EMBODIMENTS

Figure 1:
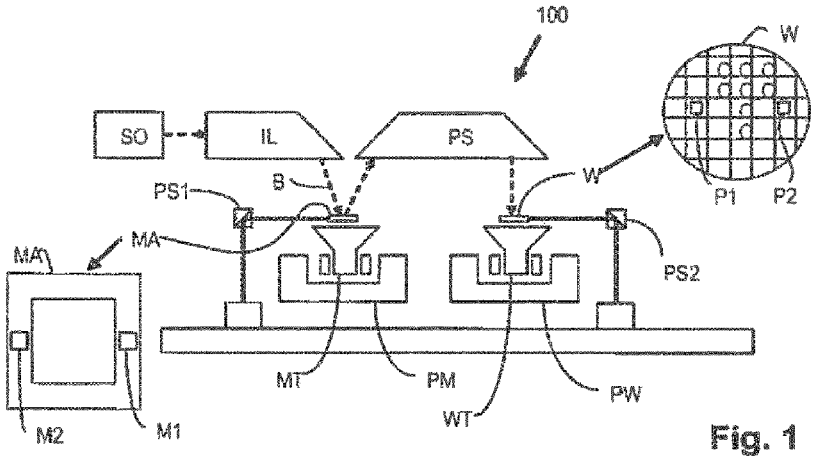
FIG. 1 depicts schematically a lithographic apparatus having reflective projection optics.

FIG. 1 schematically depicts a lithographic apparatus 100 including a source collector module SO according to one embodiment of the invention. The apparatus comprises:

an illumination system (illuminator) IL configured to condition a radiation beam B (e.g. EUV radiation).

a support structure (e.g. a mask table) MT constructed to support a patterning device (e.g. a mask or a reticle) MA and connected to a first positioner PM configured to accurately position the patterning device;

a substrate table (e.g. a wafer table) WT constructed to hold a substrate (e.g. a resist-coated wafer) W and connected to a second positioner PW configured to accurately position the substrate; and a projection system (e.g. a reflective projection system) PS configured to project a pattern imparted to the radiation beam B by patterning device MA onto a target portion C (e.g. comprising one or more dies) of the substrate W.

The illumination system may include various types of optical components, such as refractive, reflective, magnetic, electromagnetic, electrostatic or other types of optical components, or any combination thereof, for directing, shaping, or controlling radiation.

The support structure MT holds the patterning device MA in a manner that depends on the orientation of the patterning device, the design of the lithographic apparatus, and other conditions, such as for example whether or not the patterning device is held in a vacuum environment. The support structure can use mechanical, vacuum, electrostatic or other clamping techniques to hold the patterning device. The support structure may be a frame or a table, for example, which may be fixed or movable as required. The support structure may ensure that the patterning device is at a desired position, for example with respect to the projection system.

The term "patterning device" should be broadly interpreted as referring to any device that can be used to impart a radiation beam with a pattern in its cross-section such as to create a pattern in a target portion of the substrate. The pattern imparted to the radiation beam may correspond to a particular functional layer in a device being created in the target portion, such as an integrated circuit.

The patterning device may be transmissive or reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions. The tilted mirrors impart a pattern in a radiation beam which is reflected by the mirror matrix.

The projection system, like the illumination system, may include various types of optical components, such as refractive, reflective, magnetic, electromagnetic, electrostatic or other types of optical components, or any combination thereof, as appropriate for the exposure radiation being used, or for other factors such as the use of a vacuum. It may be desired to use a vacuum for EUV radiation since other gases may absorb too much radiation. A vacuum environment may therefore be provided to the whole beam path with the aid of a vacuum wall and vacuum pumps.

As here depicted, the apparatus is of a reflective type (e.g. employing a reflective mask).

The lithographic apparatus may be of a type having two (dual stage) or more substrate tables (and/or two or more mask tables). In such "multiple stage" machines the additional tables may be used in parallel, or preparatory steps may be carried out on one or more tables while one or more other tables are being used for exposure.

Referring to FIG. 1, the illuminator IL receives an extreme ultra violet radiation beam from the source collector module SO. Methods to produce EUV light include, but are not necessarily limited to, converting a material into a plasma state that has at least one element, e.g., xenon, lithium or tin, with one or more emission lines in the EUV range. In one such method, often termed laser produced plasma ("LPP") the required plasma can be produced by irradiating a fuel, such as a droplet, stream or cluster of material having the required line-emitting element, with a laser beam. The source collector module SO may be part of an EUV radiation system including a laser, not shown in FIG. 1, for providing the laser beam exciting the fuel. The resulting plasma emits output radiation, e.g., EUV radiation, which is collected using a radiation collector, disposed in the source collector module. The laser and the source collector module may be separate entities, for example when a CO2 laser is used to provide the laser beam for fuel excitation.

In such cases, the laser is not considered to form part of the lithographic apparatus and the radiation beam is passed from the laser to the source collector module with the aid of a beam delivery system comprising, for example, suitable directing mirrors and/or a beam expander. In other cases the source may be an integral part of the source collector module, for example when the source is a discharge produced plasma EUV generator, often termed as a DPP source.

The illuminator IL may comprise an adjuster for adjusting the angular intensity distribution of the radiation beam. Generally, at least the outer and/or inner radial extent (commonly referred to as σ-outer and σ-inner, respectively) of the intensity distribution in a pupil plane of the illuminator can be adjusted. In addition, the illuminator IL may comprise various other components, such as facetted field and pupil mirror devices. The illuminator may be used to condition the radiation beam, to have a desired uniformity and intensity distribution in its cross-section.

The radiation beam B is incident on the patterning device (e.g., mask) MA, which is held on the support structure (e.g., mask table) MT, and is patterned by the patterning device. After being reflected from the patterning device (e.g. mask) MA, the radiation beam B passes through the projection system PS, which focuses the beam onto a target portion C of the substrate W. With the aid of the second positioner PW and position sensor PS2 (e.g. an interferometric device, linear encoder or capacitive sensor), the substrate table WT can be moved accurately, e.g. so as to position different target portions C in the path of the radiation beam B. Similarly, the first positioner PM and another position sensor PS1 can be used to accurately position the patterning device (e.g. mask) MA with respect to the path of the radiation beam B. Patterning device (e.g. mask) MA and substrate W may be aligned using mask alignment marks M1, M2 and substrate alignment marks P1, P2.

The depicted apparatus could be used in at least one of the following modes:

1. In step mode, the support structure (e.g. mask table) MT and the substrate table WT are kept essentially stationary, while an entire pattern imparted to the radiation beam is projected onto a target portion C at one time (i.e. a single static exposure). The substrate table WT is then shifted in the X and/or Y direction so that a different target portion C can be exposed.
2. In scan mode, the support structure (e.g. mask table) MT and the substrate table WT are scanned synchronously while a pattern imparted to the radiation beam is projected onto a target portion C (i.e. a single dynamic exposure). The velocity and direction of the substrate table WT relative to the support structure (e.g. mask table) MT may be determined by the (de-)magnification and image reversal characteristics of the projection system PS.
3. In another mode, the support structure (e.g. mask table) MT is kept essentially stationary holding a programmable patterning device, and the substrate table WT is moved or scanned while a pattern imparted to the radiation beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes programmable patterning device, such as a programmable mirror array of a type as referred to above.

Combinations and/or variations on the above described modes of use or entirely different modes of use may also be employed.

Figure 2:
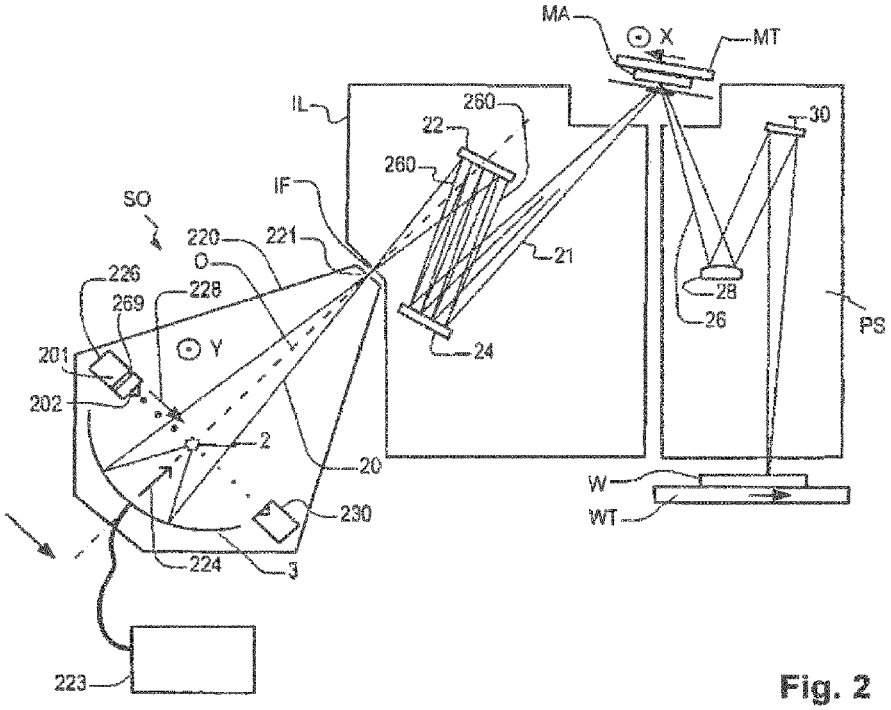
FIG. 2 is a more detailed view of the apparatus of FIG. 1.

FIG. 2 shows the apparatus 100 in more detail, including the source collector module SO, the illumination system IL, and the projection system PS. The source collector module SO is constructed and arranged such that a vacuum environment can be maintained in an enclosing structure 220 of the source collector module SO. The systems IL and PS are likewise contained within vacuum environments of their own. An EUV radiation emitting plasma 2 may be formed by a laser produced LPP plasma source. The function of source collector module SO is to deliver EUV radiation beam 20 from the plasma 2 such that it is focused in a virtual source point. The virtual source point is commonly referred to as the intermediate focus (IF), and the source collector module is arranged such that the intermediate focus IF is located at or near an aperture 221 in the enclosing structure 220. The virtual source point IF is an image of the radiation emitting plasma 2.

From the aperture 221 at the intermediate focus IF, the radiation traverses the illumination system IL, which in this example includes a facetted field mirror device 22 and a facetted pupil mirror device 24. These devices form a so-called "fly's eye" illuminator, which is arranged to provide a desired angular distribution of the radiation beam 21, at the patterning device MA, as well as a desired uniformity of radiation intensity at the patterning device MA. Upon reflection of the beam 21 at the patterning device MA, held by the support structure (mask table) MT, a patterned beam 26 is formed and the patterned beam 26 is imaged by the projection system PS via reflective elements 28, 30 onto a substrate W held by the wafer stage or substrate table WT. To expose a target portion C on substrate W, pulses of radiation are generated on substrate table WT and masked table MT perform synchronized movements 266, 268 to scan the pattern on patterning device MA through the slit of illumination.

Each system IL and PS is arranged within its own vacuum or near-vacuum environment, defined by enclosing structures similar to enclosing structure 220. More elements than shown may generally be present in illumination system IL and projection system PS. Further, there may be more mirrors present than those shown in the Figures. For example there may be one to six additional reflective elements present in the illumination system IL and/or the projection system PS, besides those shown in FIG. 2.

Considering source collector module SO in more detail, laser energy source comprising laser 223 is arranged to deposit laser energy 224 into a fuel, such as xenon (Xe), tin (Sn) or lithium (Li), creating the highly ionized plasma 2 with electron temperatures of several 10's of eV. Higher energy EUV radiation may be generated with other fuel materials, for example Tb and Gd. The energetic radiation generated during de-excitation and recombination of these ions is emitted from the plasma, collected by a near-normal incidence collector 3 and focused on the aperture 221. The plasma 2 and the aperture 221 are located at first and second focal points of collector CO, respectively.

Although the collector 3 shown in FIG. 2 is a single curved mirror, the collector may take other forms. For example, the collector may be a Schwarzschild collector having two radiation collecting surfaces. In an embodiment, the collector may be a grazing incidence collector which comprises a plurality of substantially cylindrical reflectors nested within one another.

To deliver the fuel, which for example is liquid tin, a droplet generator 226 is arranged within the enclosure 220, arranged to fire a high frequency stream 228 of droplets towards the desired location of plasma 2. In operation, laser energy 224 is delivered in a synchronism with the operation of droplet generator 226, to deliver impulses of radiation to turn each fuel droplet into a plasma 2. The frequency of delivery of droplets may be several kilohertz, for example 50 kHz. In practice, laser energy 224 is delivered in at least two pulses: a pre pulse with limited energy is delivered to the droplet before it reaches the plasma location, in order to vaporize the fuel material into a small cloud, and then a main pulse of laser energy 224 is delivered to the cloud at the desired location, to generate the plasma 2. A trap 230 is provided on the opposite side of the enclosing structure 220, to capture fuel that is not, for whatever reason, turned into plasma.

The droplet generator 226 comprises a reservoir 201 which contains the fuel liquid (e.g. molten tin) and a filter 269 and a nozzle 202. The nozzle 202 is configured to eject droplets of the fuel liquid towards the plasma 2 formation location. The droplets of fuel liquid may be ejected from the nozzle 202 by a combination of pressure within the reservoir 201 and a vibration applied to the nozzle by a piezoelectric actuator (not shown).

As the skilled reader will know, reference axes X, Y and Z may be defined for measuring and describing the geometry and behavior of the apparatus, its various components, and the radiation beams 20, 21, 26. At each part of the apparatus, a local reference frame of X, Y and Z axes may be defined. The Z axis broadly coincides with the direction optical axis O at a given point in the system, and is generally normal to the plane of a patterning device (reticle) MA and normal to the plane of substrate W. In the source collector module, the X axis coincides broadly with the direction of fuel stream 228, while the Y axis is orthogonal to that, pointing out of the page as indicated in FIG. 2. On the other hand, in the vicinity of the support structure MT that holds the reticle MA, the X axis is generally transverse to a scanning direction aligned with the Y axis. For convenience, in this area of the schematic diagram FIG. 2, the X axis points out of the page, again as marked. These designations are conventional in the art and will be adopted herein for convenience. In principle, any reference frame can be chosen to describe the apparatus and its behavior.

Numerous additional components critical to operation of the source collector module and the lithographic apparatus as a whole are present in a typical apparatus, though not illustrated here. These include arrangements for reducing or mitigating the effects of contamination within the enclosed vacuum, for example to prevent deposits of fuel material damaging or impairing the performance of collector 3 and other optics. Other features present but not described in detail are all the sensors, controllers and actuators involved in controlling of the various components and sub-systems of the lithographic apparatus.

Stability and/or clogging (i.e., at least partial blocking) of the nozzle 202 are issues that may arise during use of the nozzle 202. Clogs will be formed by contamination in the fuel. Clogging of the nozzle 202 may impose a lifetime limit on the nozzle 202 and thus the droplet generator (or at least a time limit at which limit replacement, maintenance, or cleaning is required) and may therefore limit the availability of the radiation source or the lithographic apparatus as a whole. To mitigate this, filter 269 is provided between the reservoir 201 and the nozzle 202, to filter the fuel of these contaminants before the fuel enters the nozzle. This filter 269, however, is a significantly long distance away from the nozzle 202. Because of this, the nozzle 202 is still liable to clogging, particularly from contaminants introduced between filter 269 and nozzle 202. As a result, it is normal for such a droplet generator to require replacement on a weekly basis, along with the reservoir 201, with significant machine downtime as a result.

Disclosed is a droplet generator which can accommodate one or more additional filters between the main filter and nozzle. In particular, the one or more additional filters may be located close to the actual nozzle, and in an embodiment, between actuator and nozzle. The droplet generator also enables large driving gas pressures to be used. The droplet generator may be of the Helmholtz type. The droplet generator may comprise a cylindrical-conical connection between a pump chamber and nozzle. FIG. 3 shows a droplet generator 300 comprising, in this embodiment, two fuel supply channels 305. The generator may optionally comprise one or more such channels depending on the embodiment; however, a symmetrical distribution of the fuel channels around the droplet axis is preferred. The fuel supply channels 305 receive fuel from the fuel reservoir 310 via the main filter 315. This main filter 315 may be similar to filter 269 of droplet generator 226 in FIG. 2. The fuel supply channels 305 are connected to a pump chamber 320 via throttles 325. An actuator 330 is located close to pump chamber 320. In this example, the actuator 330 comprises a piezo disk or plate, though it may be any suitable actuator for generating droplets. The actuator may be separated from pump chamber 320 by membrane 335, to ensure that the piezo is not contacted by the metal fuel. On the other side of the actuator 330 is the actuator support 338 (which may contain support circuitry for the actuator 330). A nozzle assembly comprises a first nozzle filter 345, a first duct 340, a second nozzle filter 355, a second duct 350 and a nozzle 360 in series. In the embodiment shown here, the first nozzle filter 345 is located between pump chamber 320 and the (e.g., cylindrical) first duct 340. The first nozzle filter 345 may be a plate filter. The second nozzle filter 355 is located between the first duct 340 and the (e.g., conical) second duct 350. The second nozzle filter 355 may be a plate filter, or it may be integrated with the nozzle (as described below). Nozzle 360 provides the outlet for the second duct 350, out of which fuel droplets 365 are emitted. The droplet generator may be housed within a housing 370.

The nozzle 360 may be relatively short compared to present designs, and may be comprised of a strong, non-fragile, material, for example a metal (e.g., titanium), silicon or a silicon based compound. Such a nozzle will be able to withstand high pressures within the nozzle, and therefore high fuel driving gas pressures can be used.

The main advantage of the arrangement disclosed herein, is that additional filters can be added to the fuel flow in the vicinity of the actual nozzle 360. Here two nozzle filters 345, 355 are shown, both of which being located between actuator 330 and nozzle 360. However, there may be fewer or more nozzle filters in alternative arrangements. In fact, the advantage of the ability to withstand a large driving pressure for the fuel is applicable to an embodiment without any nozzle filters, and therefore such a droplet generator 300 without nozzle filters is also envisaged. Also, the order of the elements which make up the nozzle assembly may differ to the embodiment shown.

The main filter 315 is used as a primary filter to remove the majority of the larger contaminating particles. The first nozzle filter 345 may be a plate filter comprised of silicon, coated with a silicon nitride layer, and comprising a plurality of apertures approximately the same size (e.g., diameter) as the nozzle 360. Silicon nitride is compatible with molten tin. Other coating materials compatible with molten tin, or whatever material is being used as the fuel, can also be used. Similarly materials other than silicon can be used for the filter body. The second nozzle filter 355 may be located directly before the nozzle 360. This second nozzle filter 355 may comprise a plurality of apertures somewhat smaller than the nozzle 360. The second nozzle filter 355 may be a plate filter comprised of silicon coated with silicon nitride.

In an embodiment of this disclosure, the droplets may be produced with a method called low frequency modulated continuous jet. With this method a continuous jet is decomposed in small droplets by a high frequency close to the Rayleigh frequency. These droplets, however, because of the low frequency modulation, will have slightly different velocities. In course of their flight high speed droplets overtake low speed droplets and coalesce into larger droplets spaced at a large distance. The large distance is helps to avoid the plasma influencing the trajectory of the droplets. In order to keep the collector clean from condensing fuel, high energy ions and high speed fuel fragments, directed hydrogen gas flows transport these contaminants away. The amount of fuel used is a compromise between EUV power generated and contamination of the inside of the source, especially parts in the optical path, such as the collector.

A controller controls the actuator 350 so as to control the size and separation of the droplets 365 of fuel. In an embodiment the controller controls the actuator 350 according to a signal having at least two frequencies. A first frequency is used to control the droplet generator 300 to produce relatively small droplets of fuel. This first frequency may be in the region of MHz. The second frequency is a lower frequency in the kHz range. The second frequency of the signal may be used to vary the speed of the droplets as they exit the nozzle 360 of the droplet generator 300. The purpose of varying the speeds of the droplets is to control the droplets such that they coalesce with each other so as to form larger droplets 365 of fuel, spaced at a corresponding larger distance. Note that, as an alternative to applying a low frequency modulation, an amplitude modulation may be considered as well. The nozzle of the droplet generator may be configured to comprise a Helmholtz resonator, as explained in WO2014/082811, herein incorporated by reference. The coalescence behavior may be further enhanced by adding harmonics in between the driving frequency and the Rayleigh frequency. In this respect a block wave with adjustable duty may be used to obtain shorter coalescence lengths.

Fuel droplets may be approximately spherical, with a diameter about 30 μm, usually less than the minimal dimension of the waist of the focused laser beam, being 60-450 μm. Droplets may be generated at frequencies between 40 to 320 kHz and fly towards the plasma formation location with velocities between 40 to 120 m/s, or even faster (up to 500 m/s). Desirably, the inter-droplet spacing is larger than about 1 mm (e.g, between 1 mm and 3 mm). The coalescence process may comprise between 100 to 300 droplets coalescing to form each of the larger droplets.

FIG. 4 depicts an integrated nozzle and filter arrangement 400 which may replace the second nozzle filter 355 and nozzle 360 of droplet generator 300. Whether such a droplet generator 300 also comprises the additional downstream first nozzle filter 345, or more than one additional downstream nozzle filters is optional. The integrated nozzle and filter arrangement 400 may be made out of a single substrate material 405, for example a silicon substrate material (e.g., wafer), to form a nozzle substrate. In the embodiment shown, a first side of the substrate material comprises nozzle filter 410, and a second side of the substrate material comprises nozzle 420. Both the nozzle 420 and nozzle filter 410 (e.g., apertures 430) may be comprised within thin, fuel compatible (e.g., silicon nitride), layers 440. The material between the nozzle 420 and nozzle filter 410 may be etched away to form a cavity 450, e.g., a conical cavity 450. A sacrificial layer technique may be used to etch the material. The silicon nitride layer should cover all surfaces exposed to the fuel. Apertures 430 may be smaller than the nozzle 420 opening.

The fact that the first nozzle filter 345, the second nozzle filter 355 and/or the integrated nozzle and filter arrangement 400 may be made of silicon means that it may be fabricated in clean room conditions (in a "wafer-fab") using silicon processing technologies. Therefore, risk of contamination introduced by the filter and/or nozzle is greatly reduced. Also such processing technologies are highly accurate.

It is proposed that droplet generator 300 may replace droplet generator 226 in the arrangement depicted in FIG. 2, or any other source for generating EUV (or other high frequency) radiation.

The droplet generator 300 disclosed herein enables higher droplet frequencies and therefore more fuel delivered to the plasma generation location per unit time. A droplet generator equipped with a plurality (e.g., three) filter units in line can be used for a period of time longer than a week. Additionally such an arrangement allows for the liquid refill of the fuel without stopping or exchanging the droplet generator, increasing the uptime of the scanner.

Although specific reference may be made in this text to the use of lithographic apparatus in the manufacture of ICs, it should be understood that the lithographic apparatus described herein may have other applications, such as the manufacture of integrated optical systems, guidance and detection patterns for magnetic domain memories, flat-panel displays, liquid-crystal displays (LCDs), thin-film magnetic heads, etc. The skilled artisan will appreciate that, in the context of such alternative applications, any use of the terms "wafer" or "die" herein may be considered as synonymous with the more general terms "substrate" or "target portion", respectively. The substrate referred to herein may be processed, before or after exposure, in for example a track (a tool that typically applies a layer of resist to a substrate and develops the exposed resist), a metrology tool and/or an inspection tool. Where applicable, the disclosure herein may be applied to such and other substrate processing tools. Further, the substrate may be processed more than once, for example in order to create a multi-layer IC, so that the term substrate used herein may also refer to a substrate that already contains multiple processed layers.

The term "lens", where the context allows, may refer to any one or combination of various types of optical components, including refractive, reflective, magnetic, electromagnetic and electrostatic optical components.

While specific embodiments of the invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. An EUV source configured to generate a beam of EUV radiation, wherein:

the EUV source comprises a droplet generator configured to provide droplets of fuel towards a plasma formation location;

the droplet generator comprises a nozzle assembly operable to emit the droplets, the nozzle assembly receiving the fuel from a fuel reservoir; and the nozzle assembly further comprises:

a nozzle configured for emitting the fuel forming the droplets;

a pump chamber configured for receiving the fuel from the fuel reservoir;

an actuator configured for applying a vibration to a membrane that forms a wall of the pump chamber; and at least a first nozzle filter for filtering the fuel and a second nozzle filter for filtering the fuel;

the wall having an orientation substantially perpendicular to a direction wherein the fuel is emitted from the nozzle and being configured to be in contact with the fuel in operational use of the droplet generator;

the first nozzle filter and the second nozzle filter being nonadjacently arranged in series in a path of the fuel from the pump chamber to the nozzle.

2. The EUV source of claim 1, wherein:

the nozzle assembly comprises a first duct for guiding a flow of the fuel and a second duct for guiding the fuel;

the first duct and the second duct are arranged in series between the pump chamber and the nozzle;

the first nozzle filter is arranged between the pump chamber and the first duct; and the second nozzle filter is arranged between the first duct and the second duct.

3. The EUV source of claim 2, wherein:

the second duct is adjacent the nozzle; and the second duct has a conical shape.

4. The EUV source of claim 1, wherein the nozzle is made of one of:

a metal, silicon and a silicon-based compound.

5. The EUV source of claim 1, wherein the second nozzle filter and the nozzle are physically integrated in a nozzle substrate.

6. The EUV source of claim 5, wherein the nozzle substrate comprises a silicon substrate.

7. The EUV source of claim 5, wherein:

the second nozzle filter is located at a first surface of the nozzle substrate; and the nozzle is located at a second surface of the nozzle substrate opposite the first surface.

8. A droplet generator comprising a nozzle assembly operable to emit droplets of fuel from a fuel reservoir, the nozzle assembly comprising a nozzle configured to emit the fuel forming the droplets;

a pump chamber configured to receive the fuel from the fuel reservoir;

an actuator configured to apply a vibration to a membrane that forms a wall of the pump chamber; and at least a first nozzle filter for filtering the fuel and a second nozzle filter for filtering the fuel;

wherein the wall has an orientation substantially perpendicular to a direction in which the fuel is emitted from the nozzle and is configured to be in contact with the fuel in operational use of the droplet generator, and the first nozzle filter and the second nozzle filter are nonadjacently arranged in series in a path of the fuel from the pump chamber to the nozzle.

9. A nozzle configured for use in a droplet generator of an EUV source, the nozzle being physically integrated in a nozzle substrate, the nozzle substrate additionally comprising a nozzle filter.

10. A nozzle as claimed in claim 9 wherein the nozzle substrate comprises a silicon substrate.

11. The EUV source of claim 2, wherein the nozzle is made of one of a metal, silicon, and a silicon-based compound.

12. The EUV source of claim 3, wherein the nozzle is made of one of a metal, silicon, and a silicon-based compound.

13. The EUV source of claim 2, wherein the second nozzle filter and the nozzle are physically integrated in a nozzle substrate.

14. The EUV source of claim 3, wherein the second nozzle filter and the nozzle are physically integrated in a nozzle substrate.

15. The EUV source of claim 4, wherein the second nozzle filter and the nozzle are physically integrated in a nozzle substrate.

16. The EUV source of claim 6, wherein:

the second nozzle filter is located at a first surface of the nozzle substrate; and the nozzle is located at a second surface of the nozzle substrate opposite the first surface.

17. A nozzle as claimed in claim 9 wherein the nozzle filter is physically integrated in the nozzle substrate.

* * * * *